United States Patent [19]

Sagisaka et al.

[11] Patent Number: 4,463,740

[45] Date of Patent: Aug. 7, 1984

[54] DEVICE FOR CONTROLLING ATOMIZATION OF FUEL IN INTERNAL COMBUSTION ENGINE

[75] Inventors: Yasuo Sagisaka, Kariya; Naofumi Fukue, Chiryu; Toshio Kondo, Kariya, all of Japan

[73] Assignee: Nippondenso Co., Ltd., Kariya, Japan

[21] Appl. No.: 385,266

[22] Filed: Jun. 4, 1982

[30] Foreign Application Priority Data

Jun. 9, 1981 [JP] Japan ..... 56/88450

[51] Int. Cl.[3] ..... F02B 47/08; F02M 23/08

[52] U.S. Cl. ..... 123/568; 123/587

[58] Field of Search ..... 123/585–589, 123/472, 568

[56] References Cited

U.S. PATENT DOCUMENTS

| | | | |
|---|---|---|---|
| 3,949,717 | 4/1976 | Rittmannsberger et al. | 123/587 |
| 4,351,304 | 9/1982 | Schweizer | 123/585 |
| 4,387,695 | 6/1983 | Höppel et al. | 123/587 |

*Primary Examiner*—William A. Cuchlinski, Jr.
*Attorney, Agent, or Firm*—Cushman, Darby & Cushman

[57] ABSTRACT

An apparatus for controlling the atomization of fuel in an electronically fuel injection device for internal combustion engine, by jetting air or exhaust gas into the injection device so as to mix the air or the exhaust gas with the fuel thereby to atomize the fuel. The apparatus has a regulator adapted to maintain the pressure of the air or the exhaust gas at a level higher than the pressure in the main air passage by a predetermined pressure. The regulator has a housing in which a back pressure chamber and a control chamber are defined at both sides of a diaphragm accommodated by the housing. The back pressure chamber receives the air pressure transmitted from the downstream side of a throttle valve and accommodates a spring which urges the diaphragm toward the control chamber, while the control chamber receives the air from the upstream side of the throttle valve or the exhaust gas. A valve operatively connected to the diaphragm opens and closes the passage between the control chamber and the fuel injection device thereby to control and regulate the pressure of the air or the exhaust gas supplied to the fuel injection device.

2 Claims, 6 Drawing Figures

DEVICE FOR CONTROLLING ATOMIZATION OF FUEL IN INTERNAL COMBUSTION ENGINE

BACKGROUND OF THE INVENTION

The present invention relates to an apparatus for controlling atomization of fuel by mixing air, capable of saving fuel and decreasing emission without deteriorating the driving feeling of the internal combustion engine during warming up thereof.

When the temperature of engine is low, the fuel discharged into the intake pipe attach to the intake valve and walls around the intake valve and is then evaporated and sucked into the cylinder. Therefore, a certain time lag of supply of fuel is caused as compared with the fuel supply after the warming up of the engine. In consequence, a large amount of noxious gases is emitted from the engine in the cold state, i.e. during warming up, to impose a serious problem from the view point of restriction of exhaust emission.

Although several systems have been proposed for controlling the fuel supply during the warming up upon detect of the state of operation of the engine, these systems are unsatisfactory and imperfect because the method of detection of the state of engine operation cannot be regarded as being adequate in view of demand for correction of fuel supply. Namely, an attempt for decreasing the noxious emissions positively often results in an excessive or insufficient fuel supply to deteriorate the feeling of driving of the engine. Another problem is that, if the demand for correction of fuel supply is determined in accordance with the time after the start up of the engine, it is not possible to obtain a good feel of acceleration in the period immediately after the start up.

SUMMARY OF THE INVENTION

Accordingly, an object of the invention is to provide a device for controlling atomization of fuel in internal combustion engine, capable of overcoming the above-described problems of the prior art.

To this end, according to the invention, metered air from the upstream side of a throttle valve or exhaust gas from the exhaust system is introduced to an air regulator, and the air or the exhaust gas is controlled to be higher than the pressure in the intake pipe by a predetermined pressure. The air or the exhaust gas is then supplied to the area around the injector nozzle of each cylinder and mixed with the fuel. In consequence, the penetration of fuel is decreased to reduce the tendency of attaching of fuel to the intake pipe wall and so forth and, in addition, to promote the atomization of fuel. This in turn offers various advantages such as shortening of the start-up time, reduction of noxious exhaust emission in the cold state of the engine, reduction of fuel consumption and so forth.

The above and other objects, features and advantages of the invention will become clear from the following description of the preferred embodiment taken in conjunction with the accompanying drawings.

DESCRIPTION OF THE PREFERRED EMBODIMENTS

Figure 1:
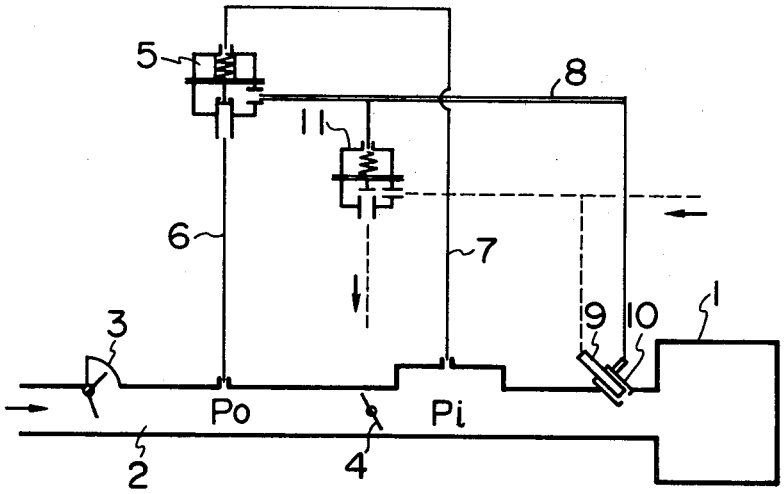
FIG. 1 is a schematic system diagram of an apparatus for controlling the atomization of fuel in internal combustion engine, constructed in accordance with an embodiment of the invention.

FIG. 1 schematically shows an apparatus for controlling the atomization of fuel in internal combustion engine, in accordance with an embodiment of the invention. In this Figure, full lines show the paths of flow of air while broken lines show the paths of flow of fuel.

Figure 5:
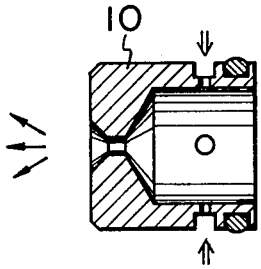
FIG. 5 is a sectional view of an adapter incorporated in the apparatus shown in FIG. 1.

An air passage 2 for supplying fuel to each cylinder of the associated engine 1 is provided with an air flow meter 3 and a throttle valve 4 downstream from the air flow meter. An air inlet pipe 6 of an air regulator 5 is connected to the portion of the main air passage 2 between the flow meter 3 and the throttle valve 4. The air regulator 5 is provided with a back pressure chamber connected to the portion of the main air passage 2 downstream from the throttle valve 4, through a conduit 7. An air discharge pipe 8 of an air regulator 5 is connected to the adapter 10 (see FIG. 5) of an electronically controlled fuel injection device 9 having a construction known per se.

On the other hand, a part of the fuel is delivered by means of a pump or the like to the fuel injection device 9 while the reminder of the fuel is returned to a tank through a fuel pressure regulator 11 which is known per se. The pressure in an air outlet pipe 8 of the air regulator 5 is supplied to the back pressure chamber of the fuel pressure regulator 11.

Figure 2:
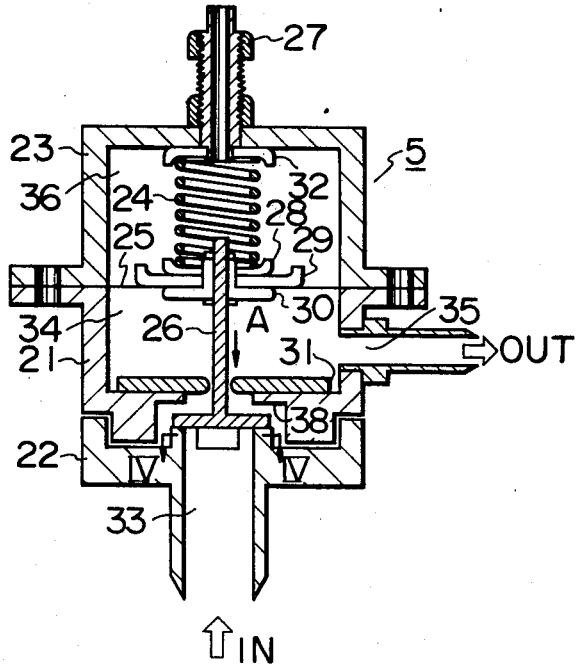
FIG. 2 is a vertical sectional view of an air regulator incorporated in the apparatus shown in FIG. 1.
Figure 3:
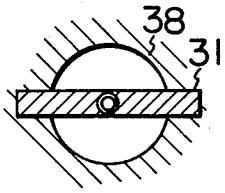
FIG. 3 is an illustration of air regulator as viewed in the direction of arrow A.
Figure 4:
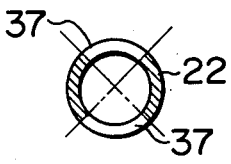
FIG. 4 is a sectional view taken along the line IV—IV of FIG. 2.

Referring now to FIG. 2 showing in section the air regulator incorporated in the apparatus shown in FIG. 1, the air regulator 5 has housing parts 21, 22 and 23 which in combination constitute a housing. A reference numeral 24 denotes a spring, while a reference numeral 25 denotes a diaphragm. Numerals 26 and 27 denote, respectively, a valve member and a bolt for adjusting the control pressure. The valve member 26 is assembled together with the lower holders 28, 29, 30 for the spring 24 and also with the diaphragm 25, so that these members are adapted to move up and down as a unit with one another. The lower end surface of the housing part 21 and the upper side surface of the valve member 26 constitute seat surfaces. A member 31 intended for preventing the oscillation of the valve member 26 has a shape as shown in FIG. 3 when viewed in the direction of arrow A in FIG. 2. The bolt 27 makes a close contact with the upper holder 32 for the spring 24 and is movable vertically to vary the pressure on the valve member 26 thereby to permit the adjustment of the control pressure. A part of the air metered by the air flow meter 3 is introduced to the inlet port 33 of the air regulator 5 through the air inlet pipe 6. This air forcibly opens the valve member 26 and flows into the control chamber 34 in the regulator through a restriction passage between the valve member and the notched part 37 (See FIG. 4) of the housing portion 22. The air introduced into the control chamber is controlled to have a predetermined pressure differential determined by the set load of the spring 24 from the pressure in the main air passage 2, and is introduced to the adapter 10 of the fuel injection device 9 from an outlet 35 through the air discharge pipe 8.

If the pressure in the control chamber 34 of the air regulator 5 becomes higher than the pressure in the back pressure chamber 36 for a certain disturbance, the pressure is applied to the diaphragm having a predetermined effective pressure receiving surface, so that the valve member 26 is lifted to contact the valve seat portion 38 of the housing part 21 thereby to close the passage. However, since the outlet 35 of the control chamber 34 is communicated with the air inlet pipe 6, the pressure in the control chamber 34 is gradually lowered and, hence, the valve member 26 is lowered until it takes a position where a balance is obtained between the force produced by the pressure in the control chamber 34 and the force produced by the pressure in the back pressure chamber 36 with the assistance of the spring 24, so that the pressure in the control chamber 34 is maintained at the set level.

To the contrary, if the pressure in the control chamber 34 is lowered, the diaphragm 25 is deflected downwardly to displace the valve member 26 to the lowermost position in its stroke. However, air is introduced into the control chamber 34 through the notched part 37 of the housing part 22 to deflect the diaphragm 25 upwardly to keep the valve member 26 at the predetermined position where the balance of force is obtained, so that the pressure in the control chamber 34 is held at the set level.

Figure 6:
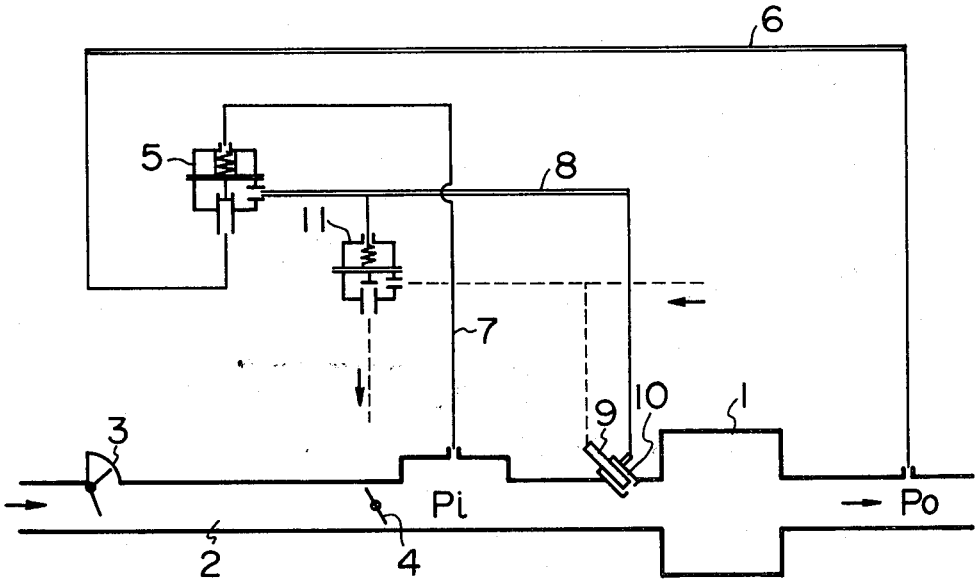
FIG. 6 is a schematic system diagram of an apparatus in accordance with another embodiment of the invention.

FIG. 6 shows another embodiment of the invention in which exhaust gas is introduced to the upstream side of the apparatus of the invention, insteadly of the intake air in the preceding embodiment explained in connection with FIGS. 1 through 5.

As has been described, the apparatus for controlling atomization of fuel in accordance with the invention promotes the atomization of fuel advantageously and effectively suppresses the attaching of fuel to the intake valve or pipe walls around the valve. In consequence, the apparatus of the invention offers various advantages such as shortening of time for starting up the engine, decrease of noxious exhaust emission in the cold state of the engine, reduction in the fuel consumption and so forth. These advantages have been confirmed through a test conducted by the present inventors using actual automobiles.

Although the invention has been described through specific terms, the described embodiments are not exclusive and various changes and modifications may be imparted thereto without departing from the scope of the invention which is limited solely by the appended claims.

What is claimed is:

1. An apparatus for controlling atomization of fuel in an internal combustion engine having a main air intake passage and a throttle valve therein, comprising:

an air regulator adapted to control the pressure of air injected to be mixed with fuel in an electronically controlled fuel injection device such that the pressure of the injected air is higher than the pressure in the main air passage by a predetermined pressure, said air regulator including:

a housing;

a diaphragm disposed in said housing and cooperating with said housing in defining a back pressure chamber at one side thereof and a control chamber at the other side thereof;

a spring disposed in said back pressure chamber;

means for transmitting the air pressure in the passage at the downstream side of the throttle valve into said back pressure chamber; means for introducing the air pressure in the passage at the upstream side of the throttle valve into said control chamber; and a valve member operatively connected to said diaphragm and adapted to control, in accordance with the deflection of said diaphragm, the pressure of the air to be supplied to the fuel injection device, whereby there is maintained a constant pressure differential between the pressure at the downstream side of the throttle valve and the pressure in said control chamber thereby to obtain a uniform particle size of the atomized fuel.

2. An apparatus for controlling atomization of fuel in internal combustion engine having a main air passage and a throttle valve therein, comprising:

a regulator adapted to control the pressure of exhaust gas injected to be mixed with fuel in an electronically controlled fuel injection device such that the pressure of the injected exhaust gas is higher than the pressure in the main air passage by a predetermined pressure, said regulator including:

a housing;

a diaphragm disposed in said housing and cooperating with said housing in defining a back pressure chamber at one side thereof and a control chamber at the other side thereof;

a spring disposed in said back pressure chamber;

means for transmitting the air pressure at the downstream side of the throttle valve into said back pressure chamber;

means for introducing the exhaust gas into said control chamber; and a valve member operatively connected to said diaphragm and adapted to control, in accordance with the deflection of said diaphragm, the pressure of said exhaust gas to be supplied to the fuel injection device, whereby there is maintained a constant pressure differential between the pressure at the downstream side of the throttle valve and the pressure in said control chamber thereby to obtain a uniform particle size of the atomized fuel.

* * * * *